US005633908A

United States Patent [19]

Rindby et al.

[11] Patent Number: 5,633,908

[45] Date of Patent: May 27, 1997

[54] PORTABLE MICRO-X-RAY-SPECTROMETER

[75] Inventors: Anders Rindby, Göteborg, Sweden; Panu Jalas, Helsinki, Finland

[73] Assignees: Metorex International Oy, Espoo, Finland; X-ray Capillary Optics AB, Goteborg, Sweden

[21] Appl. No.: 563,661

[22] Filed: Nov. 28, 1995

[30] Foreign Application Priority Data

Nov. 30, 1994 [SE] Sweden ..... 9404149

[51] Int. Cl.[6] ..... G21K 1/06

[52] U.S. Cl. ..... 378/145; 378/84; 378/44

[58] Field of Search ..... 378/145, 147, 378/160, 161, 119, 43, 44, 70, 71, 84, 85, 204

[56] References Cited

U.S. PATENT DOCUMENTS 4,395,775 7/1983 Roberts et al. ..... 378/145
5,001,737 3/1991 Lewis et al. ..... 378/145
5,101,422 3/1992 Thjel et al. ..... 378/145
5,276,724 1/1994 Kumasaka et al. ..... 378/161

*Primary Examiner*—David P. Porta
*Assistant Examiner*—Don Wong
*Attorney, Agent, or Firm*—Smith-Hill and Bedell

[57] ABSTRACT

The invention relates to a measuring element for a portable micro-X-ray spectrometer, said element comprising a radiation protected housing, at least an X-ray source, a detector, cooling parts for the detector and means for activating the X-ray source and the detector. In accordance with the invention, in order to advantageously guide the X-rays obtained by the X-ray source away from the radiation protected housing (1), at least one capillary tube (3) has been mounted in the X-ray source (4), said capillary tube (3), at the opposite end of the tube as seen from the X-ray source, being connected to a hole formed in the detector (5) for conducting the X-rays out of the radiation protected housing (1). The inner section of the capillary tube (3) is smaller at the end which, seen from the X-ray source, is opposite than at the end at the X-ray source (4).

6 Claims, 1 Drawing Sheet

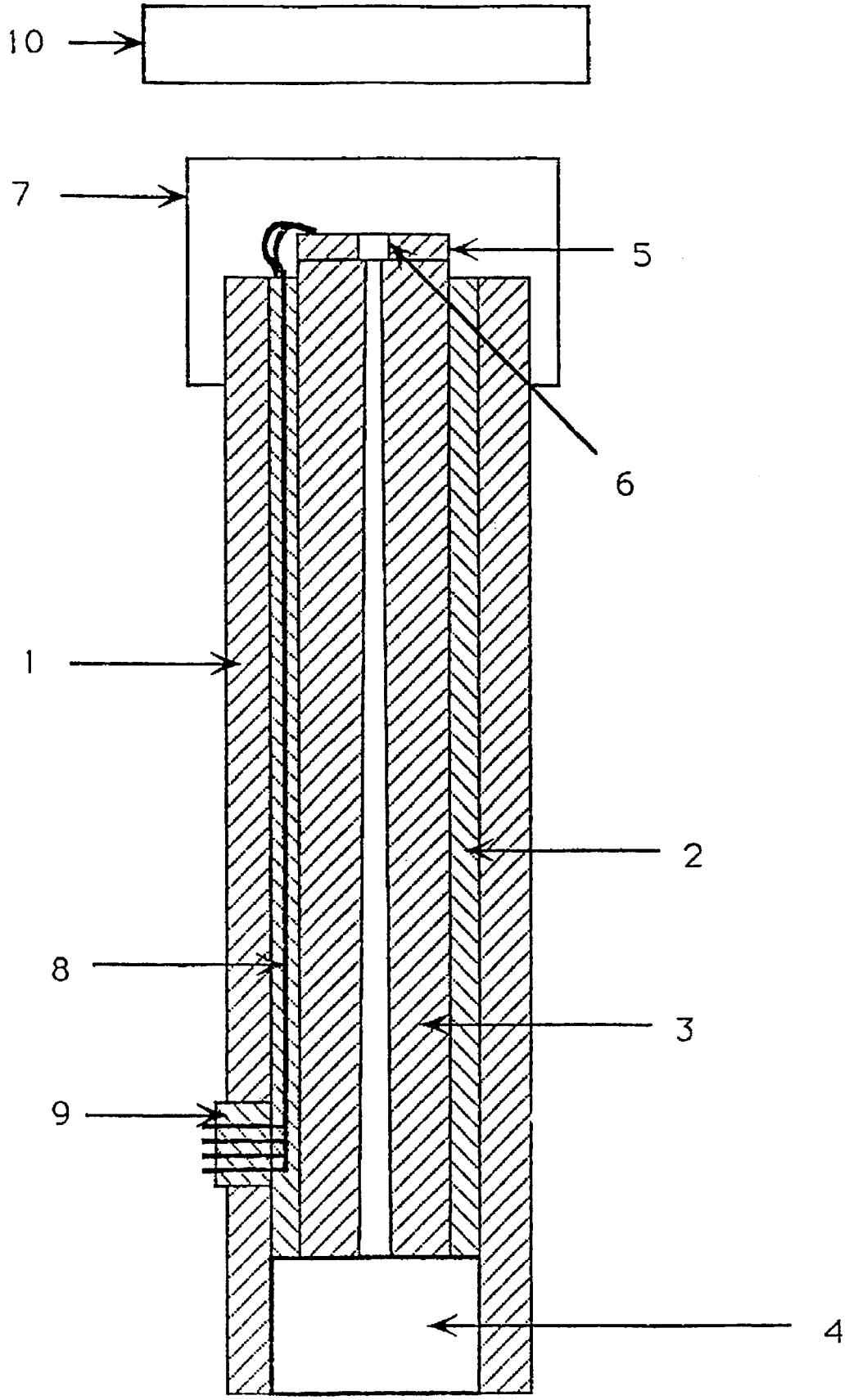
10
7
5
6
1
2
8
3
9
4

PORTABLE MICRO-X-RAY-SPECTROMETER

The present invention relates to a portable micro-X-ray spectrometer, in particular to the measuring element located in the spectrometer by means of which the contents of elements on the surface of a specimen are measured and which is based on capillary optics and on a detector made by means of planar processing technics.

Capillary optics have for instance been described in the Article Attaelmanan A. et al., Rev. Sci. Instrum. 65 (1), 1994. Capillary optics are based on a capillary tube through which the radiation is directed towards the object which is to be examined. Thanks to the capillary tube, the radiation is propagated substantially in a rectilinear and concentrated way, it being possible to direct the intensity of the radiation in its entirety towards the object to be examined.

A detector made by planar processing technics may either be based on a diode made with high-resistive silicium or on a drift chamber. Diodes made with high-resistive silicon have for instance been described in the article Kemmer J., Nucl. Instr. and Meth. A169, (1980) p.499. Regarding drift chambers the article Rehak P. et al., Nucl. Instr. and Meth. A235 (1985) p. 224 and the article Chen W. et al., Nucl. Instr. and Meth. A326 (1993) p. 273 have been published, which describe a large drift chamber with a hole placed in an ion beam source which is sensitive in regard of space requirements. In a detector made by planar processing technics, the X-rays, which are natural for elements, from the elements in the object to be examined can be separated and identified also at room temperature, it not being necessary to put the detector into a low-temperature state, for instance surrounded by liquid nitrogen.

The object of the present invention is to utilize the present level of technology to make it possible to make a portable X-ray spectrometer utilizing a detector made by means of capillary optics and planar processing technics, by which means it is to be possible to determine the contents of the elements on the surface of the specimen to be examined by means of an X-ray pulse. The essential characteristics of the invention are set forth in the appended claims. The main components of a measuring element in a portable X-ray spectrometer according to the invention are radiation source, capillary optics focusing the X-rays and an energy-dispersive detector made of semiconductor material. The radiation generated by the radiation source, which advantageously for instance may be an isotope source or an X-ray tube, is conducted to at least one capillary tube mounted in the immediate vicinity of the radiation source. The capillary tube is advantageously designed in such a way that the space in the tube decreases in the direction of propagation of the radiation by which means the radiation is focused and substantially the entire intensity of the radiation can be conducted towards the surface of the object to be examined. The radiation is conducted from the capillary tube through a hole in the detector, the radiation being directed towards the piece which is placed before the detector and which is to be examined. The atoms on the surface of the device to be examined then emit fluorescent X-rays which are characteristic for the kind of atom in question. The intensity of the generated fluorescent X-rays is measured by the detector, which can distinguish between the fluorescent radiation of the different elements by means of its energy-dispersive capability. The detector is furthermore connected to a multichannel analyzer which performs the identification of the elements.

In a device according to the invention capillary tubes advantageously are used both as wave guides for the radiation and as focusing optics. By these means a microscopically thin X-ray beam can be obtained which has a high intensity. According to the invention the diameter of the capillary tube used is between 20–200, preferably 50–100 micron at the end closest to the radiation source. The capillary tube is shaped in such a way that the diameter of the capillary tube, seen from the radiation source, is smaller at the opposite end than at the end closest to the radiation source. The inner surface of the tube is advantageously at least partly conical. By these means the intensity of the radiation which is propagated in the capillary tube can be focused on an successively diminishing area by which means the usefulness of the intensity can be further increased.

In a device according to the invention the capillary tube is, as seen from the detector, placed in such a way that the capillary tube is mounted in a hole substantially in the center of the detector. Depending on the diameter of the capillary tube, the diameter of the hole is between 50–200, preferably 80– 140 microns. Thanks to the focusing of the capillary tube the radiation from the tube advantageously passes through the hole and does not essentially hit the detector. In a device according to the invention a configuration comprising several capillary tubes can also be used. In this case a hole is made in the detector for each capillary tube which goes through the detector.

In a device according to the invention advantageously a detector made of high-resistive silicon is used, such as a diode or a drift chamber. This kind of detector gives a substantially good energy-dispersion with a Peltier cooler. The cooling devices of the detector thus can be made more simple than they for instance would be if liquid nitrogen in accordance with the prior art were used. In accordance with the invention the detector advantageously functions in the temperature range –30° C.–30° C. Thanks to the simple design of the cooling device, the specimen to be examined can be placed very close to the detector.

When the device according to the invention is used the focused X-rays are conducted to the specimen to be examined, which is situated very close, by means of the capillary tube mounted in the hole made in the detector. The X-rays impinging on the surface of the specimen then cause fluorescent X-rays which are characteristic for the elements on the surface, a substantial part thereof being directed towards the detector. The detector receives a large part of the generated fluorescent X-rays, since the specimen is located very close to the detector. The results of the measurements will also be more reliable since the amount of radiation arriving at the detector increases. The location of the specimen very close to the detector means that the size of the entire X-ray spectrometer can be made very small, which improves the functionality of the device as a portable device.

The invention is described in more detail below with reference to the appended drawings showing an advantageous application of the invention in sections seen from the side.

According to the Figure a holder 2 has been mounted in a radiation protected housing 1 by which means the capillary tube 3 has been mounted located in the housing 1 so that the other end of the capillary 3 substantially forms a closed system together with the X-ray source 4. The inside of the capillary tube is at least partly conical with a cone angle of 0–1 degrees such that the inner part with respect to the diameter is largest at that end which is located closest to the X-ray source 4. The X-ray source is also mounted inside the housing 1. The capillary tube 3 is connected to a hole 6 formed in the detector 5 at the end opposite to the X-ray source 4 so that the capillary tube 3 forms an open system together with the environment of the housing. A cooling element 7 functioning as a Peltier element has been mounted around the detector and the end of the housing closest to the detector, by which means the detector 6 can be held within a temperature range which is advantageous for the function of the detector 5. In the figure the layout 8 of the cables and a connecting piece 9 for the cables, by the means of which the X-ray source 4 the detector 5 and the cooling element 7 can be made to function in the advantageous way in accordance with the invention.

When a device according to the invention functions, the X-ray source 4 generates an X-ray pulse which is directed to the capillary tube 3. Thanks to the inner, conical surface, the X-ray pulse is focused when it passes through the tube capillary tube 3. The fluorescent X-rays generated on the surface which is characteristic for the different elements on the surface is directed towards the detector 5 being located around the hole 6, the detector receiving the intensities of the incoming radiation. For determination of the different elemental contents on the surface of the specimen 10, the obtained intensities are processed further in the connected devices which have been electrically connected by means of the cable-connecting piece 9.

We claim:

1. Measuring element for portable micro-X-ray spectrometer comprising a radiation protected housing, at least one source of X-rays, a detector, a cooling part for the detector and means for activating the X-ray source and the detector, characterized in that, in order to advantageously guide the X-rays obtained by the X-ray source away from the radiation protected housing (1), at least one capillary tube (3) has been mounted in the X-ray source (4), said capillary tube (3), at the opposite end of the tube as seen from the X-ray source, being connected to a hole formed in the detector (5) for conducting the X-rays out of the radiation protected housing.

2. Measuring element according to claim 1, characterized in that the inner part of the capillary tube at least partly is conical for focusing the X-rays.

3. Measuring element according to claim 2, characterized in that the inner cone angle of the capillary tube (3) is between 0–1 degrees.

4. Measuring element according to claim 1, characterized in that the hole (6) in the detector (5) is located substantially centrally in the surface of the detector.

5. Measuring element according to claim 1, characterized in that the detector (5) is a diode made of semiconductor material.

6. Measuring element according to claim 1, characterized in that the detector (5) is a drift chamber made of semiconductor material.

* * * * *